US006064918A

United States Patent [19]

Ohtsukasa et al.

[11] Patent Number: 6,064,918

[45] Date of Patent: May 16, 2000

[54] ANTI-INTERFERENCE DEVICE FOR CONSTRUCTION MACHINE

[75] Inventors: Naritoshi Ohtsukasa, Isehara; Hiroshi Yoshinada, Machida; Kenji Okamura; Kunikazu Yanagi, both of Hiratsuka, all of Japan

[73] Assignee: Komatsu Ltd., Japan

[21] Appl. No.: 09/015,859

[22] Filed: Jan. 29, 1998

[30] Foreign Application Priority Data

Jan. 31, 1997 [JP] Japan ..... 9-018834

[51] Int. Cl.[7] ..... G06F 155/00

[52] U.S. Cl. ..... 700/91; 700/52; 700/86; 700/169; 700/175; 172/2; 172/4; 172/25; 172/456; 701/50; 701/51

[58] Field of Search ..... 700/91, 86, 52, 700/54, 60, 69, 169, 175, 180, 186, 192, 194; 172/2, 4, 7, 9, 215–221, 311–373, 456, 477; 701/50, 51, 52, 53

[56] References Cited

U.S. PATENT DOCUMENTS

| | | | |
|---|---|---|---|
| 4,296,409 | 10/1981 | Whitaker et al. | 340/684 |
| 4,365,672 | 12/1982 | Robinson, Jr. et al. | 172/2 |
| 4,381,036 | 4/1983 | Fardal et al. | 172/2 |
| 4,413,685 | 11/1983 | Gremelspacher et al. | 172/430 |
| 4,721,168 | 1/1988 | Kinzenbaw | 172/311 |
| 4,747,301 | 5/1988 | Bellanger | 73/117.3 |
| 5,598,794 | 2/1997 | Harms et al. | 111/177 |
| 5,648,898 | 7/1997 | Moore-McKee et al. | 700/86 |
| 5,696,687 | 12/1997 | DeMotte et al. | 700/114 |
| 5,724,264 | 3/1998 | Rosenberg et al. | 700/192 |
| 5,847,960 | 12/1998 | Cutler et al. | 700/194 |
| 5,880,957 | 3/1999 | Aardema et al. | 700/114 |

*Primary Examiner*—Paul P. Gordon
*Assistant Examiner*—Ramesh Patel
*Attorney, Agent, or Firm*—Greer, Burns & Crain, Ltd.

[57] ABSTRACT

Detecting section detects joint angles and the relative angle of rotation from a plurality of rotatable operating tools mounted on a single mobile platform of a construction machine. Interference distance calculator, having recorded predetermined point positions for each operating tool, derives the distances between the plurality of operating tools on the basis of the detection results and the point positions, and calculates the shortest approach distance from these distances. If this shortest approach distance is less than a prescribed set distance, anti-interference controller issues a warning to alarm via the output controller, and it outputs anti-interference control to hydraulic control section CC such that the approaching tool is halted or slowed down, or the velocity of the operating tool being approached is matched to that of the approaching tool depending on the set mode.

7 Claims, 5 Drawing Sheets

HALT MODE

AUTOMATIC AVOIDANCE MODE

DECELERATION MODE

ANTI-INTERFERENCE DEVICE FOR CONSTRUCTION MACHINE

BACKGROUND OF THE INVENTION

1. Field of the Invention

The present invention relates to an anti-interference device for a construction machine which moves by means of a mobile platform and performs operations by means of a plurality of rotatable operating tools, whereby it is possible completely to prevent interference between the main unit of a construction machine and a plurality of operating tools, or between the plurality of operating tools.

2. Description of the Related Art

Anti-interference devices have conventionally been provided in construction machines such that interference between the construction machine main unit, such as the mobile platform and the operating tools is prevented.

For example, Japanese Patent Publication 2-58411, which relates to a hydraulic shovel having a single back-hoe front attachment, discloses a method for restricting the range of operation, whereby a range of operation within which the crawler belts, etc. of the hydraulic shovel do not interfere with the operating tool is previously set, and when the detection results for the position of the operating tool move outside this range of operation, the operation of the operating tool is restricted.

There also exist anti-interference devices for construction machines which prevent interference between operating tools in construction machines comprising a plurality of operating tools on a single mobile platform.

For example, Japanese Patent Publication 58-19828 relates to a construction machine comprising a single rotatable back-hoe tool and an earth-moving device, wherein the lower position of the back-hoe boom cylinder and the upper position of the blade of the earth-moving device are detected by limit switches, the angle of rotation of the back-hoe is also detected, and an interference region within which the boom cylinder and earth-moving blade will interfere with other is set on the basis of these detection results, an alarm being operated when this interference region is entered. Similarly, Japanese Patent Publication 58-19827 discloses a device wherein operation in the vicinity of this interference region is automatically halted. Moreover, Japanese Patent Publication 58-45539 discloses a device wherein the velocity of approach towards this interference region is reduced.

However, since all of the conventional anti-interference devices for construction machinery described above relate to machines comprising only a single rotatable operating tool mounted on a single mobile platform, the process of predicting the interference region between operating tools or between an operating tool and the main unit of the construction machine is relatively simple, and this interference region can be set in advance, whereas in a construction machine comprising a plurality of rotatable operating tools mounted on a single mobile platform, wherein each operating tool operates freely and independently, it is difficult to set the interference region between the operating tools in advance.

In other words, since each rotatable tool on a single mobile platform is operated independently, the relative positional relationships between the operating tools change continuously in a complex manner, and consequently, it is not easy to completely prevent interference between the operating tools, and there is enormous burden on the tool operator.

Moreover, in a construction machine comprising a plurality of rotatable tools mounted on a single mobile platform, there are cases where the plurality of operating tools are used co-operatively. For example, where an object held or supported by one operating tool is transferred to another operating tool provided on the same mobile platform, and if the operating tools are simply prevented from approaching each other, co-operative operation which is a feature of such construction machines will, conversely, become impossible to implement.

SUMMARY OF THE INVENTION

Therefore, it is an object of the present invention to eliminate these problems by providing an anti-interference device for a construction machine, whereby interference between operating tools and between an operating tool and the main unit of a construction machine is prevented completely in a reliable and simple manner, even when a plurality of rotatable tools are provided on a single mobile platform, thereby reducing the burden on the operator, and it is a further object of the present invention to provide an anti-interference device for a construction machine, whereby safe operation can be implemented even when a plurality of operating tools are used co-operatively.

In order to achieve this object, in an anti-interference device for a construction machine which moves by means of a mobile platform and performs operations by means of a plurality of rotatable tools, the present invention comprises: detecting means for detecting joint angles for each of the plurality of operating tools and the relative angle of rotation between the plurality of operating tools; calculating means for determining the configuration of the construction machine including the plurality of operating tools on the basis of the detection results from the detecting means, and calculating the shortest approach distance between the construction machine main unit and the plurality of operating tools and between the plurality of operating tools; and control means for implementing control such that interference between the construction machine main unit and the plurality of operating tools and between the plurality of operating tools is prevented on the basis of the shortest approach distance.

Furthermore, in the present invention, the plurality of operating tools rotate about the same axis.

Thereby, it is possible completely to prevent interference between the operating tools and between the operating tools and the construction machine main unit.

In the present invention, the control means implements control such that operation of the operating tools which causes the shortest approach distance to decrease is prohibited, when the shortest approach distance has fallen below a prescribed value.

Thereby, it is possible reliably to prevent interference, whilst reducing the burden on the operator for preventing interference.

In the present invention, the control means controls the tool being approached such that, when the shortest approach distance has fallen below a prescribed value, the tool being approached and the approaching tool are separated by at least the shortest approach distance.

Thereby, it is possible reliably to prevent interference, whilst reducing the burden on the operator for preventing interference.

In the present invention, the control means implements control such that the velocity of movement of the approaching tool is reduced to a velocity corresponding to the shortest approach distance, when the shortest approach distance has fallen below a prescribed value.

In the present invention, the control means implements control such that the velocity of movement of the approaching tool is reduced to a velocity corresponding to the shortest approach distance, when the shortest approach distance has fallen below a prescribed value, and after the velocity reduction, the approaching tool is halted.

Thereby, it is possible reliably to prevent interference, whilst reducing the burden on the operator for preventing interference, and in particular, it is possible to implement co-operative operation of a plurality of operating tools in a safe manner.

The present invention further comprises warning means for warning of interference in the construction machine, and the control means implements control such that a warning is issued by the warning means at the least, when the shortest approach distance has fallen below a prescribed value.

Thereby, it is possible to convey the danger of interference reliably to the operator.

DESCRIPTION OF THE PREFERRED EMBODIMENTS

Embodiment of the present invention will now be described with reference to the drawings.

Figure 1:
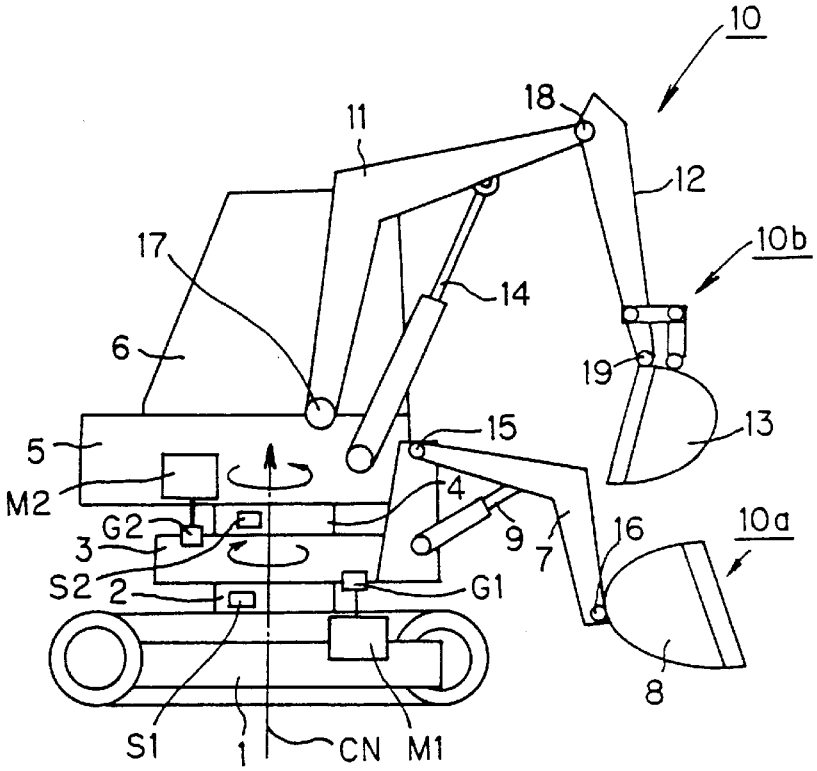
FIG. 1 is a side view showing the configuration of a construction machine which is an embodiment of the present invention.

FIG. 1 is a side view showing the configuration of a construction machine which is an embodiment of the present invention.

In FIG. 1, the construction machine 10 comprises a mobile platform which is a platform having a movement function. FIG. 1 shows a crawler type of mobile platform 1, but a platform fitted with tires (wheels) may also be used.

A rotating mechanism 2 which can rotate freely through 360° in a horizontal direction is provided on the upper portion of the mobile platform 1, and a case 3 is fixed to this rotating mechanism 2. A loading tool 10*a* is supported on one end of this base 3. The loading tool 10*a* supported at the end of the base 3 comprises a loader arm 7 driven by a lift cylinder 9, and a loader bucket 8 supported at the end of this loader arm 7.

A rotating mechanism 4 which can rotate freely through 360° in a horizontal direction is also provided on the upper portion of the base 3, and this rotating mechanism 4 is fixed to base 5. A back-hoe tool 10*b* is supported at one end of this base 5. The back-hoe tool 10 supported at the end of base 5 comprises a boom 11 driven by a boom cylinder 14, an arm 12 supported at the end of this arm 11, and a bucket 13 supported at the end of this arm 12. A driver's cabin 6 is fixed to the upper side of base 5, and the operator manipulates the loading tool 10*a* and back-hoe tool 10*b* from the driver's cabin 6.

The mobile platform 1 comprises a rotating motor M1 for causing the rotating mechanism 2 to rotate, and this rotating motor M1 causes the base 3 to rotate via a gear G1. The angle of rotation created by the rotation of base 3 is detected by an angle of rotation detector S1, which is formed by an encoder, or the like, fitted to the swing circle etc. of the rotating mechanism 2. The base 5 comprises a rotational motor M2 for causing the rotating mechanism 4 to rotate, and this rotational motor M2 engages with the base 3 by means of a gear G2, such that by driving the rotational motor M2, the base 5 is caused to rotate with respect to the base 3. This relative angle of rotation is detected by an angle of rotation detector S2, which is formed by an encoder, or the like, fitted to the swing circle etc. of the rotating mechanism 4. Therefore, in order to find the particular angle of rotation of the loading tool 10*b* on base 5 with respect to the mobile platform 1, the relative angle of rotation according to angle of rotation detector S2 is added to the angle of rotation according to angle of rotation detector S1. In other words, when rotational motor M2 for base 5 is not driven, base 5 rotates with base 3, and in order to halt movement of base 5 when base 3 is rotated, base 5 must be rotated in the opposite direction to the rotation of base 3.

Furthermore, angle detectors 15, 16, formed by rotary encoders, rotational potentiometers, or the like, are also provided on the axis of rotation of each joint in the loading tool 10*a*, for detecting the angle of rotation of the joint. Similar angle detectors 17, 18, 19 are provided on the axis of rotation of each joint in the back-hoe tool 10*b*, for detecting the angle of rotation of the joint.

In this way, the construction machine 10 comprises two operating tools, a loading tool 10*a* and a back-hoe tool 10*b* mounted on a single mobile platform 1, and both tools 10*a* and 10*b* are independently rotatable through 360° about a common axis of rotation formed by the single central axis of rotation CN. Here, the driver's cabin 6 is fixed to base 5, but a further rotating mechanism may, of course, also be provided on base 5, such that the driver's cabin 6 can be rotated independently.

Figure 2:
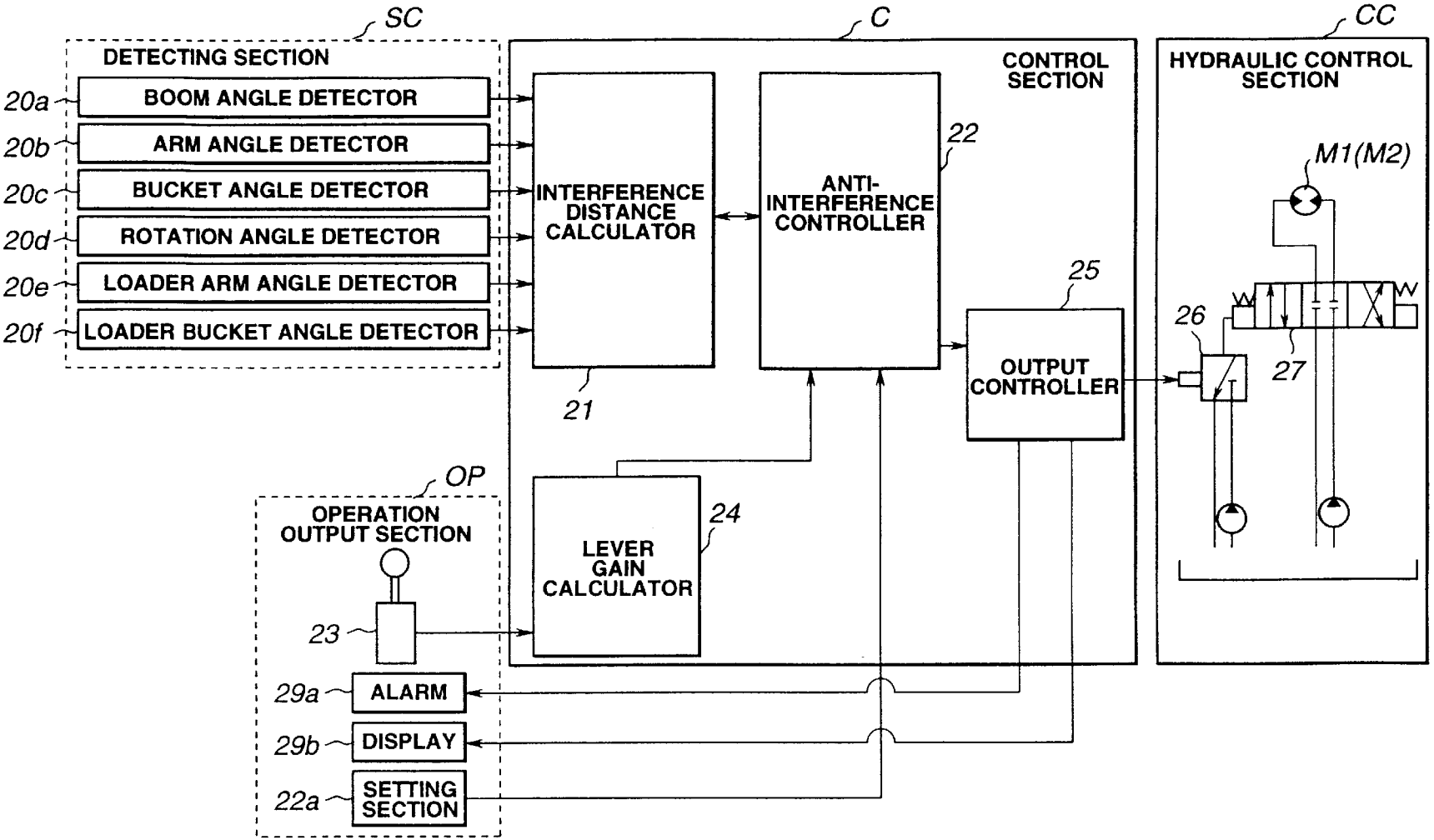
FIG. 2 is a diagram showing the configuration of an anti-interference device for a construction machine which is the embodiment of the present invention.
Figure 4:
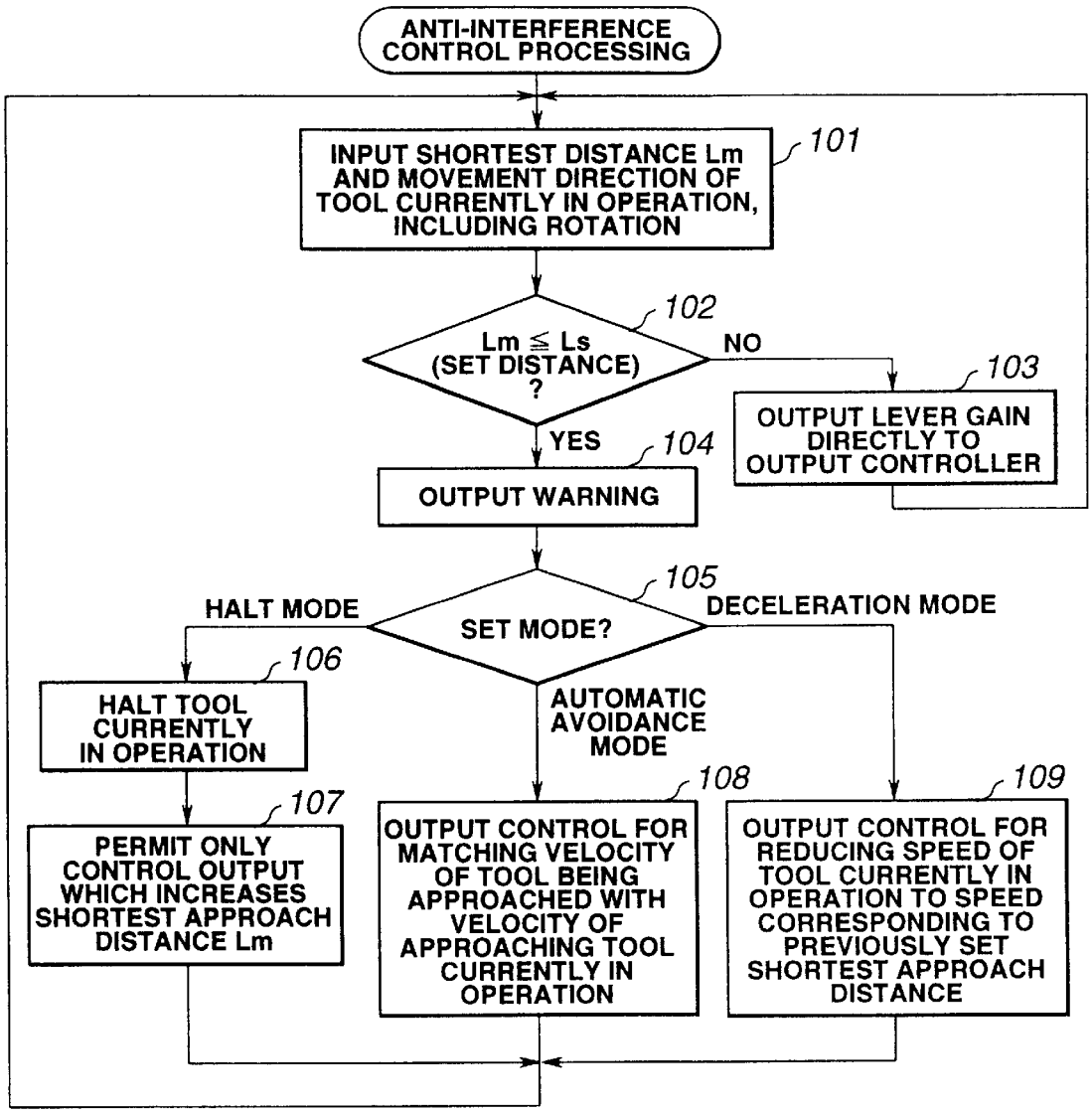
FIG. 4 is a flow-chart showing an anti-interference control processing sequence as implemented in an anti-interference controller.

Next, an anti-interference device for the construction machine 10 illustrated in FIG. 1 is described with reference to FIG. 2. This diagram shows the configuration of an anti-interference device for construction machine 10, and in broad terms, it comprises a detecting section SC, operation output section OP, control section C, and hydraulic control section CC.

The detecting section SC comprises a plurality of detectors 20*a*–20*h*, and each detector 20*a*–20*f* gathers information from the corresponding angle of rotation detector 15–19 and angle of rotation detector S1, S2, and converts the detection processing results to information of a prescribed format, which it transmits to the control section C. In other words, the boom angle detector 20*a*, arm angle detector 20*b*, bucket angle detector 20*c*, loader arm angle detector 20*e*, and loader bucket angle detector 20*f* reconvert angle information detected respectively by angle detectors 17, 18, 19, 15, 16 to analogue or digital electrical signals, and transmit these to the control section C. Furthermore, the angle of rotation detector 20*d* takes the angle information from angle of rotation detectors S1 and S2, and converts it to electrical signals corresponding to the relative angle of rotation between the tools 10*a* and 10*b*, and their relative angle of rotation with respect to the mobile platform 1. The various conversion functions in the detecting section SC may be accommodated in the interference distance calculator 21 described later, or if these various conversion functions are not required, the signals from the angle detectors 16–19 and the angle of rotation detectors S1, S2 may be input directly to the interference distance calculator 21.

The control section C comprises an interference distance calculator 21, anti-interference controller 22, lever gain calculator 24 and an output controller 25.

The interference distance calculator 21 calculates the shortest approach distance Lm between the tools 10*a*, 10*b* and between the tools 10*a*, 10*b* and the mobile platform 1 on the basis of the angle at the joints of the tools 10*a*, 10*b* and the relative angle of rotation of the operating tools, as input by the detecting section SC, and it also calculates the direction of movement of the operating tool in its current operation and transmits these calculation results to the anti-interference controller 22. The calculational processing implemented in the interference distance calculator 21 is described later.

The lever gain calculator 24 converts gain signals corresponding to inputs from the operating lever 23 to electrical signals, which it outputs to the anti-interference controller 22.

The anti-interference controller 22 judges whether or not the shortest approach distance Lm input from the interference distance calculator 21 is less than a previously determined set distance Ls, and it conducts anti-interference control processing according to a variety of set modes on the basis of these judgement results.

On the basis of the control processing results from the anti-interference controller 22, the output controller 25 implements control which it outputs to the hydraulic control section CC controlling the hydraulic systems of the tools 10*a* and 10*b*, an alarm 29*a* which gives a warning of interference, and a display 29*b*, which displays successively at least a warning of interference or the shortest approach distance Lm, and the like.

The hydraulic control section CC controls the rotational motors M1, M2 and also controls the hydraulic cylinder 28 of the lift cylinder 9 or boom cylinder 14, and the like. The output control electrical signals from the output controller 25 are input to an electromagnetic proportional valve 26, which outputs a pilot pressure for controlling a main valve 27 to the main valve 27 on the basis of the output control electrical signal. The main valve 27 controls switching on the basis of the input pilot pressure, thereby controlling the driving of rotational motors M1, M2, and the like:

Next, the process for calculating the shortest approach distance Lm in the interference distance calculator 21 is described with reference to FIG. 3.

Firstly, the interference distance calculator 21 records in advance a plurality of positions where there is a possibility of interference for each of group of units comprising the tools 10*a* and 10*b*, including the bases, and the mobile platform 1. These groups are based on operating units including rotation of the operating tools, and they are used because interference occurs between operating units. For example, for the back-hoe tool 10*b*, the position of points P1, Pc, Pd, etc. at the corners of the bucket 13 are recorded as distances from the joint. Furthermore, for the loading tool 10*a*, the positions of the points P2, Pa, Pb, etc. at the corners of the loader bucket 8 are recorded as distances from the joint. The positions of the corners of the mobile platform 1 are recorded similarly. Here, the positions recorded are optional, and an equidistant interval with respect to the physical surface of the construction machine 10 may be set.

Thereupon, when angle information for the axes of rotation of the joint and angle information for the relative angle of rotation is input from the detecting section SC, the interference distance calculator 21 calculates the position of the operating tools on the basis of this angle information, and converts all the recorded positions to absolute positions. It also calculates the distances between all of the absolute positions for the different group combinations on the basis of these absolute positions, and the shortest of these calculated distances is set as the shortest approach distance Lm.

Figure 3:
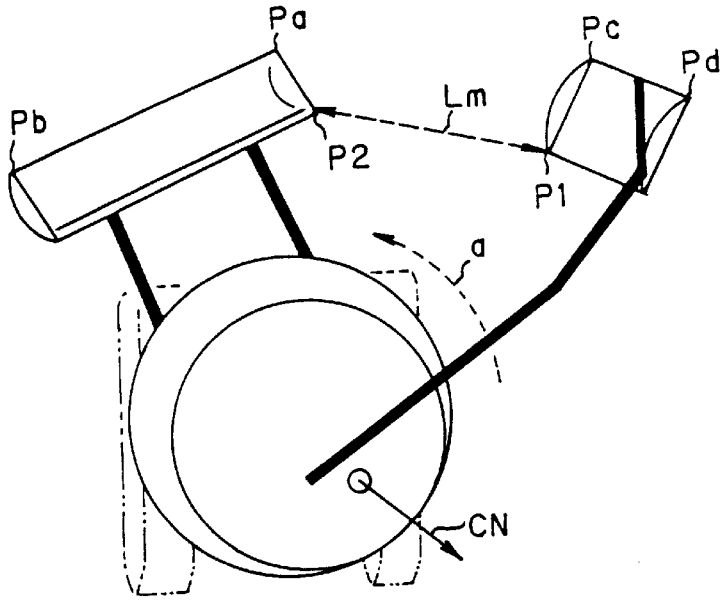
FIG. 3 is a diagram describing the essential points of calculating the shortest approach distance Lm by means of an interference distance calculator.

For example, in FIG. 3, the shortest approach distance between the back-hoe tool 10*b* and loading tool 10*a* is found by calculating the distance between P1 and P2, Pa and Pb, the distance between Pc and P2, Pa and Pb, and the distance between Pd and P2, Pa and Pb, and setting the shortest of these calculated distances, namely, the distance between P1 and P2, as the shortest approach distance Lm.

The direction of movement (direction of approach) can be determined from detected changes in position on the basis of the relative angle of rotation and the angle of rotation at the rotational axes in the joints.

Next, an anti-interference control processing sequence as implemented in the anti-interference controller 22 is described with reference to the flowchart shown in FIG. 5.

Figure 5A:
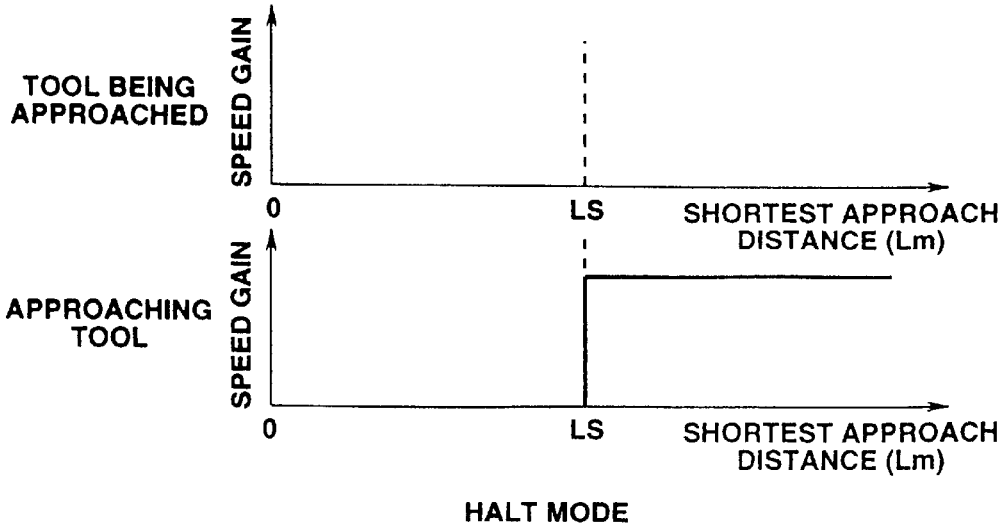
FIGS. 5(*a*) through 5(*c*) are diagrams describing various modes set by the anti-interference controller.
Figure 5B:
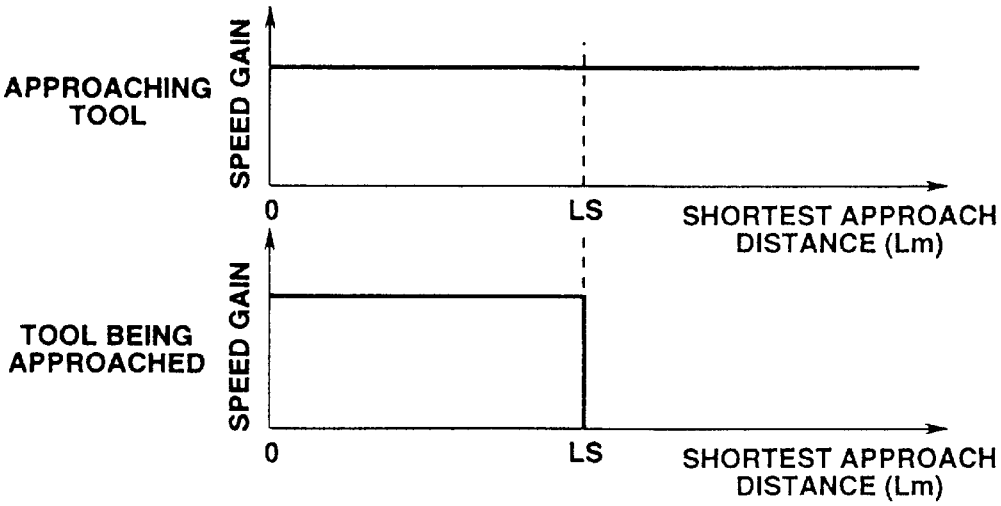
Figure 5C:
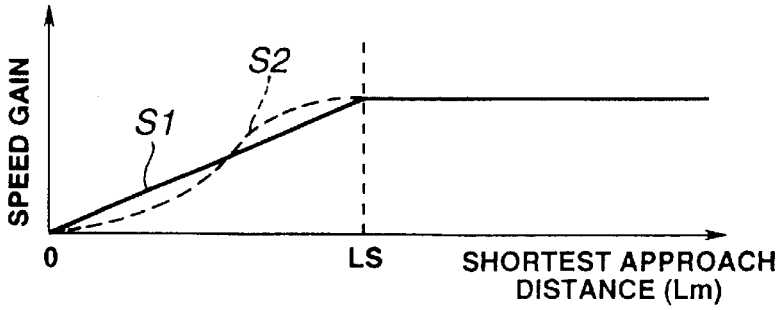

In FIG. 5, firstly, the anti-interference controller 22 inputs the shortest approach distance Lm and the direction of movement in the current operation, including rotation, from the interference distance calculator 21 (step 101). It then judges whether or not the shortest approach distance Lm is less than a previously determined set distance Ls (step 102), and if the shortest approach distance Lm is not less than the set distance Ls, it controls the device such that the lever gain input from the lever gain calculator 24 is output directly to the output controller 25 (step 103), whereupon the sequence returns to step 101.

On the other hand, if the shortest approach distance Lm is less than the set distance Ls, an instruction is output to the output controller 25 such that the alarm 29*a* issues a warning indicating that there is a possibility of interference (step 104).

Next, in order to conduct control processing for the current set mode, it is determined which of the set modes is currently set (step 105). There are three set modes: halt mode, automatic avoidance mode and deceleration mode, the details of which are described later.

When it is determined at step 105 that halt mode is set, firstly, the operating tool currently in operation is halted (step 106), and then processing is conducted such that only control output in a direction of operation which increases the shortest approach distance Lm is permitted (step 107), whereupon the sequence returns to step 101.

When it is determined at step 105 that the automatic avoidance mode is set, a control is output such that the velocity of the operating tool being approached matches the velocity of the approaching tool which is currently in operation (step 108), whereupon the sequence returns to step 101.

When it is determined at step 105 that the deceleration mode is set, a control is output such that the operating tool currently in operation is slowed to a predetermined velocity corresponding to the shortest approach distance Lm (step 109), whereupon the sequence returns to step 101.

In this way, control processing for preventing interference corresponding to a variety of set modes is implemented repeatedly when the shortest approach distance Lm is less than a prescribed distance Ls.

Next, each of the predetermined set modes is described with reference to FIG. 5. FIG. 5(*a*) shows the relationship between the shortest approach distance Lm and velocity gain in halt mode. In this mode, when the operating tool being approached is at rest, control processing is implemented such that the velocity gain is set to 0 when the shortest approach distance Lm falls below a set distance Ls. Therefore, even if a lever gain is input to the anti-interference controller 22 by the operating lever 23, the operating tool currently in operation is ultimately halted because the velocity gain is set to 0. Specifically, the velocity of the approaching tool is matched to that of the operating tool being approached.

FIG. 5(*b*) shows the relationship between the shortest approach distance Lm and velocity gain in automatic avoidance mode. In the automatic avoidance mode, even if the shortest approach distance Lm is less than the set distance Ls, the approaching tool, which is the operating tool currently in operation, is maintained at the same velocity gain as usual and the operation of this approaching tool is not interrupted. On the other hand, the operating tool being approached is caused to move such that its velocity matches that of the approaching tool, when the shortest approach distance Lm is less than the set distance Ls, and hence its velocity gain is set to the same gain as the approaching tool, and the operating tool being approached is therefore controlled by means of this gain such that the shortest approach distance Lm between it and the approaching tool is maintained at the set distance Ls.

FIG. 5(*c*) shows the relationship between the shortest approach distance Lm and the velocity gain in deceleration mode. In deceleration mode, when the shortest approach distance Lm is less than the set distance Ls, the operating tool currently in operation is caused to slow down. In other words, velocity gains corresponding to the size of the shortest approach distance Lm are previously determined, and when the shortest approach distance Lm is less than the set distance Ls, a velocity gain corresponding to the current shortest approach distance Lm is output to the output controller 25. As shown in FIG. 5(*c*), the relationship between the shortest approach distance Lm and the velocity gain in the region where the shortest approach distance Lm is less than the set value Ls may form a linear gain 51 whereby the velocity gain is reduced in direct proportion to the decrease in the shortest approach distance Lm, or it may form a gain curve 52. Of course, if the shortest approach distance Lm is 0, then the velocity gain is set to 0, to prevent completely any impact between the operating tools, at the least. The deceleration mode is particularly useful when the two tools 10*a* and 10*b* are being used co-operatively. Cooperative operation refers, for instance, to tasks where earth etc. excavated by the loading tool 10*a* is gathered up by the back-hoe tool 10*b*, or tasks where earth etc. held in the back-hoe tool 10*b* is transferred to a loading tool 10*b* or the vicinity thereof.

Here, the anti-interference controller 22 judges interference prevention with reference to a single set distance Ls, but besides this, it is also possible to control the shortest approach distance Lm in a step fashion on the basis of a plurality of set distances Ls.

If stepped control is implemented in this way, it is possible, for example, to indicate the danger of interference with respect to the shortest approach distance by changing the alarm tone issued by the alarm 29*a* in a step fashion, and it is also possible to combine different set modes smoothly.

Furthermore, the set mode or set distance Ls, and the like, determined by the anti-interference controller 22 described above may be set in advance by the setting section 22*a*, and they may be altered during operation according to circumstances.

The display 29*b*, in addition to displaying the state of the settings determined by the setting section 22*a*, may also display quantitative values for the current shortest approach distance Lm in a sequential fashion.

Moreover, the anti-interference control device may search for the most appropriate means of avoiding interference, and these detection results may be displayed on the display 29*b* or output in the form of sound from a sound output section, or the like, which is omitted from the drawings.

Next, a construction machine 20 which is an applicational example of the aforementioned embodiment of the present invention is described with reference to FIG. 6.

Figure 6A:
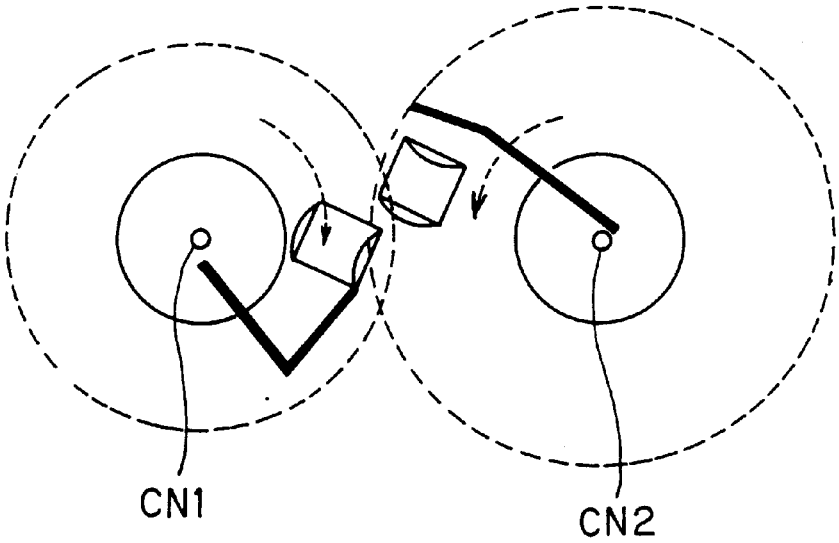
FIGS. 6(*a*) and 6(*b*) are diagrams showing the configuration of a construction machine which is an example of the embodiment of the present invention.
Figure 6B:
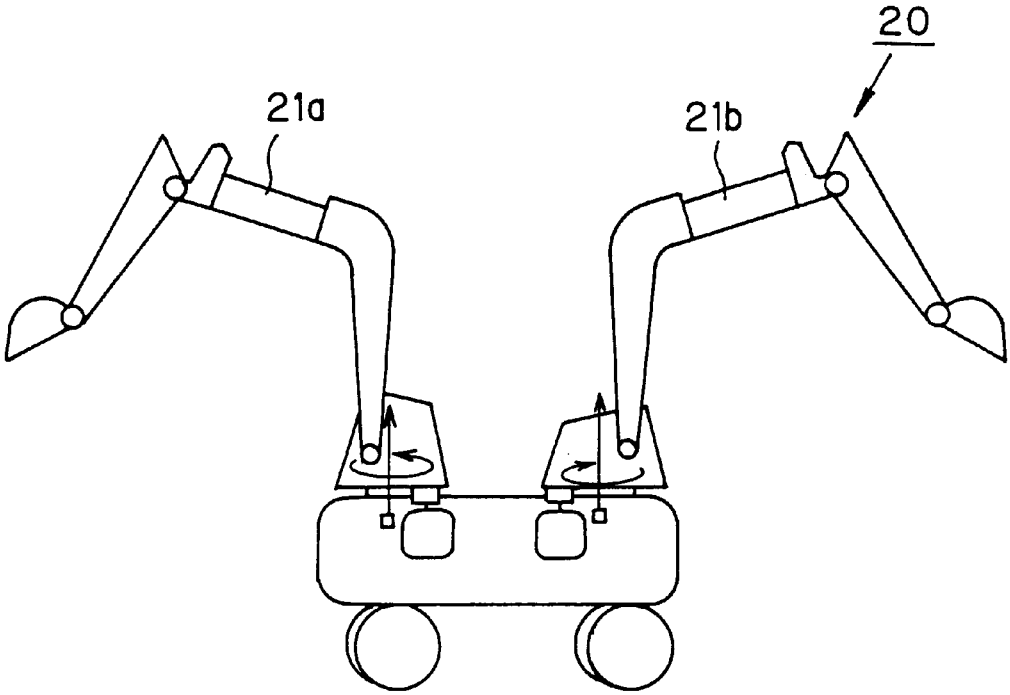

FIG. 6 shows the configuration of a construction machine 20 which is an applicational example of the embodiment of the present invention. The construction machine 20 differs from construction machine 10 in that it has a mobile platform fitted with tires, as opposed to a crawler mechanism, and its tools 21*a*, 21*b* rotate independently about two difference central axes of rotation (Cn1 and CN2, but the two construction machines are similar in that they comprise two rotatable tools mounted on a single mobile platform.

In construction machine 20, interference between the tools 21*a* and 21*b* may occur, as shown in FIG. 6(*a*), similarly to construction machine 10.

Therefore, it is possible to prevent interference between the tools 21*a*, 21*b*, and interference between the tools 21*a*, 21*b* and the mobile platform, by providing construction machine 20 with the anti-interference device for construction machine 10 described above.

Since there is a possibility of interference even when the tools 21*a*, 21*b* rotate in the same direction, then in the automatic avoidance mode in particular, it is necessary to provide control which takes the characteristics of the operating tools mounted on different rotational axes into account, by, for instance, controlling the device such that the operating tools rotate in opposite directions, rather than the same direction, or reducing the velocity of one operating tool and increasing the velocity of the other operating tool, or the like.

What is claimed is:

1. An anti-interference device for a construction machine which moves by means of a mobile platform and performs operations by means of a plurality of rotatable operating tools, comprising:

detecting means for detecting joint angles for each of the plurality of operating tools and the relative angle of rotation between the plurality of operating tools;

calculating means for determining the configuration of the construction machine including the plurality of operating tools on the basis of the detection results from the detecting means, and calculating the shortest approach distance between the construction machine main unit and the plurality of operating tools and between the plurality of operating tools; and control means for implementing control such that interference between the construction machine main unit and the plurality of operating tools and between the plurality of operating tools is prevented on the basis of the shortest approach distance.

2. The anti-interference device for a construction machine according to claim 1, wherein the plurality of operating tools rotate about the same axis.

3. The anti-interference device for a construction machine according to claim 1, wherein the control means implements control such that operation of the operating tools which causes the shortest approach distance to decrease is prohibited when the shortest approach distance has fallen below a prescribed value.

4. The anti-interference device for a construction machine according to claim 1, wherein the control means controls an operating tool being approached such that the operating tool being approached and an approaching operating tool are separated by at least the shortest approach distance when the shortest approach distance has fallen below a prescribed value.

5. The anti-interference device for a construction machine according to claim 1, wherein the control means implements control such that velocity of movement of an approaching operating tool is reduced to a velocity corresponding to the shortest approach distance when the shortest approach distance has fallen below a prescribed value.

6. The anti-interference device for a construction machine according to claim 1, wherein the control means implements control such that velocity of movement of an approaching operating tool is reduced to a velocity corresponding to the shortest approach distance when the shortest approach distance has fallen below a prescribed value, and after the velocity reduction, the approaching operating tool is halted.

7. The anti-interference device for a construction machine according to claim 1, further comprising warning means for warning of interference between the construction machine main unit and the plurality of operating tools and between the plurality of operating tools, wherein the control means implements control such that a warning is issued by the warning means when the shortest approach distance has fallen below a prescribed value.

* * * * *